US007802606B2

(12) United States Patent
Landry

(10) Patent No.: US 7,802,606 B2
(45) Date of Patent: Sep. 28, 2010

(54) FOLDING STORM SHUTTERS

(76) Inventor: Rachel R. Landry, 3115 Olias Rd., Erath, LA (US) 70533

( * ) Notice: Subject to any disclaimer, the term of this patent is extended or adjusted under 35 U.S.C. 154(b) by 93 days.

(21) Appl. No.: 12/219,763

(22) Filed: Jul. 28, 2008

(65) Prior Publication Data

US 2009/0025318 A1 Jan. 29, 2009

Related U.S. Application Data

(60) Provisional application No. 60/935,132, filed on Jul. 27, 2007.

(51) Int. Cl.
*E04F 10/10* (2006.01)

(52) U.S. Cl. ..... 160/62; 49/67; 52/202

(58) Field of Classification Search ..... 160/62, 160/61, 83.1; 49/67, 61, 63; 52/202, 473.1, 52/69

See application file for complete search history.

(56) References Cited

U.S. PATENT DOCUMENTS

| | | | | |
|---|---|---|---|---|
| 1,039,582 | A * | 9/1912 | Osgood | 160/62 |
| 1,662,721 | A * | 3/1928 | Schneider | 160/57 |
| 1,668,938 | A * | 5/1928 | Bucknam, Jr. et al. | 160/62 |
| RE17,550 | E * | 1/1930 | Bucknam, Jr. et al. | 160/62 |
| 2,004,674 | A * | 6/1935 | Quisenberry | 160/60 |
| 2,774,416 | A | 12/1956 | Angus | |
| 2,853,128 | A * | 9/1958 | Bomerscheim | 160/62 |
| 3,516,470 | A | 6/1970 | Kurz | |
| D231,921 | S | 6/1974 | Rosenbaum | |
| 4,384,436 | A | 5/1983 | Green | |
| 4,604,827 | A | 8/1986 | Hitchins | |
| 4,620,503 | A | 11/1986 | Pullens | |
| 4,799,525 | A | 1/1989 | Seymour | |
| 5,335,452 | A | 8/1994 | Taylor | |
| 5,477,903 | A | 12/1995 | Figueiredo et al. | |
| 6,536,174 | B2 | 3/2003 | Foster et al. | |
| 2004/0040230 | A1 | 3/2004 | Taegar | |
| 2007/0044926 | A1 | 3/2007 | Zuniga | |

FOREIGN PATENT DOCUMENTS

| | | |
|---|---|---|
| FR | 2 598 745 | 11/1987 |
| JP | 4-224417 | 8/1992 |
| JP | 2001-132361 | 5/2001 |

OTHER PUBLICATIONS

Folding Shutters, @ 2005, http://www.foldingshutters.com/.

* cited by examiner

*Primary Examiner*—Blair M. Johnson
(74) *Attorney, Agent, or Firm*—Richard C. Litman

(57) ABSTRACT

The folding storm shutter provides a shutter for protecting a window during inclement weather, and shade similar to that provided by an awning when window protection is not required. The folding storm shutter has an upper shutter panel and a lower shutter panel pivotally attached to the lower edge of the upper shutter panel so that the lower shutter panel can be extended to cover the entire window, and, alternatively, the lower shutter panel can be placed in a folded configuration against the upper shutter panel when not needed for window protection. A latching mechanism is provided for selectively retaining the lower shutter panel in the folded configuration. Hinges pivotally attach the upper shutter panel to the window frame. A rod removably supported by brackets on opposite sides of the window may be used to support the shutter in the folded configuration.

8 Claims, 4 Drawing Sheets

FOLDING STORM SHUTTERS

CROSS-REFERENCE TO RELATED APPLICATION

This application claims the benefit of U.S. Provisional Patent Application Ser. No. 60/935,132, filed Jul. 27, 2007.

BACKGROUND OF THE INVENTION

1. Field of the Invention

The present invention relates to devices for protecting windows from damage due to storms and wind, and more particularly to a folding storm shutter for protecting a building window from storm damage.

2. Description of the Related Art

Tropical window coverings, such as shutters and awnings, are frequently used to provide shade, security and protection from storm damage for windows in homes. Storm shutters may be louvered, i.e., they may have a framework with a plurality of slanted slats, either fixed or movable. Storm shutters are typically pivotally attached to opposite sides of a window by hinges, pivoting laterally. While shutters may be attached to the building by hinges above the window, such a construction is unusual. When the weather is calm, it is desirable to open the shutter(s) to let light in through the windows and/or to open the windows for ventilation, yet it is also desirable to provide some shade while not blocking one's view of the outdoors. A shutter pivotally attached above the window would require a brace to hold the shutter open, and it is difficult to hold a vertically mounted shutter open far enough to let in sufficient light and ventilation, but not so far that it cannot provide shade without blocking one's view of the outdoors, in an aesthetically pleasing manner.

Moreover, some geographic regions may be more subject to severe weather events, such as hurricanes and tornados, than other geographic regions. In such areas, it may be desirable to provide more robust window protection than that provided by louvered shutters with thin slats that may be decorative, but do not provide sufficient protection against strong winds and flying debris.

Thus, a folding storm shutter solving the aforementioned problems is desired.

SUMMARY OF THE INVENTION

The folding storm shutter provides a shutter for protecting a window during inclement weather, and shade similar to that provided by an awning when window protection is not required. The folding storm shutter has an upper shutter panel and a lower shutter panel pivotally attached to the lower edge of the upper shutter panel so that the lower shutter panel can be extended to cover the entire window, and, alternatively, the lower shutter panel can be placed in a folded configuration against the upper shutter panel when not needed for window protection. A latching mechanism is provided for selectively retaining the lower shutter panel in the folded configuration. Hinges pivotally attach the upper shutter panel to the window frame. A horizontal rod removably supportable by two brackets mounted laterally across from each other on the window side frame, or to the building on opposite sides of the window, functions as a support for the shutter when it is in the folded configuration.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
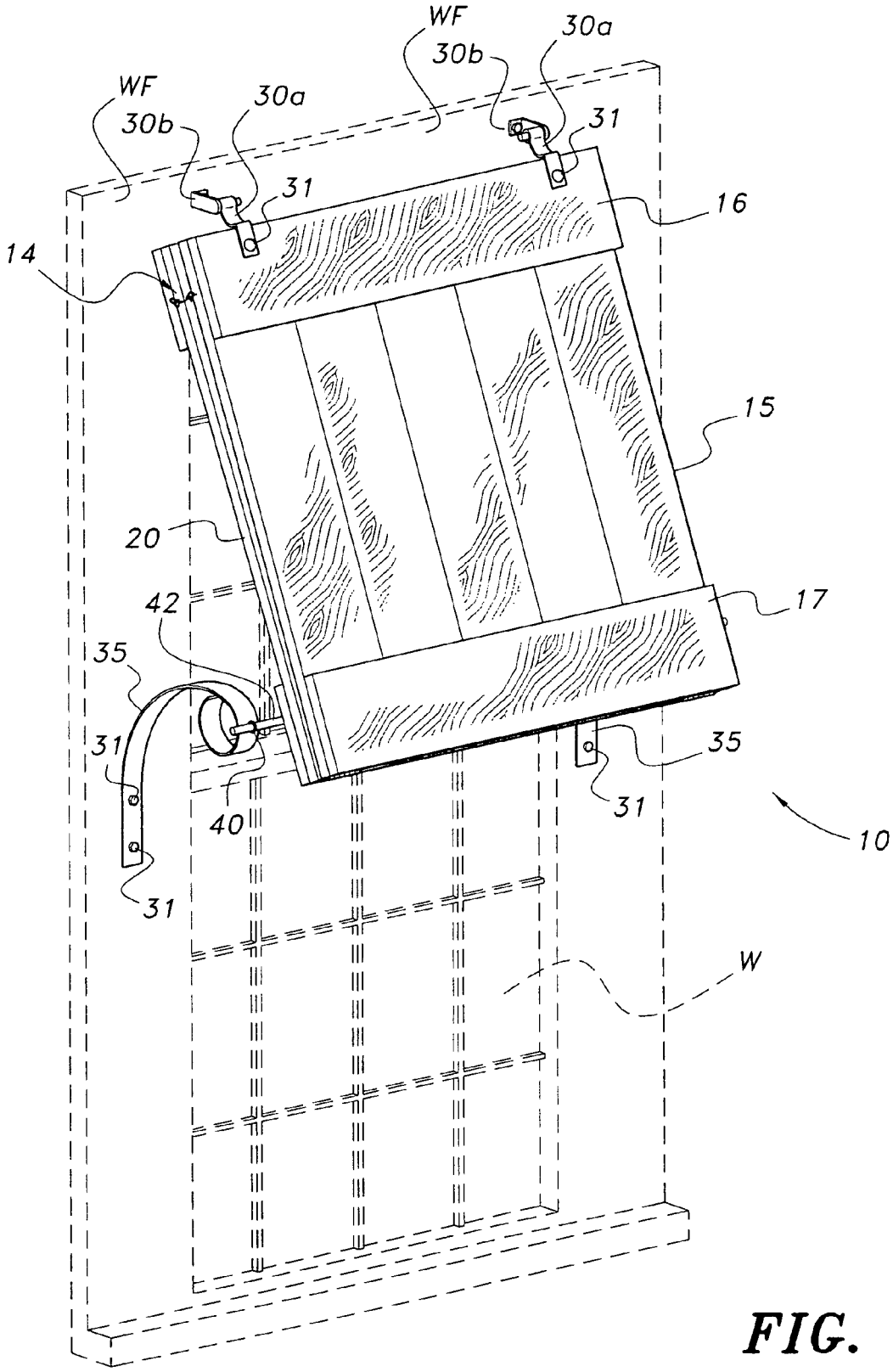
FIG. 1 is an environmental perspective view of a folding storm shutter according to the present invention in a folded configuration to provide shade for a window.
Figure 2:
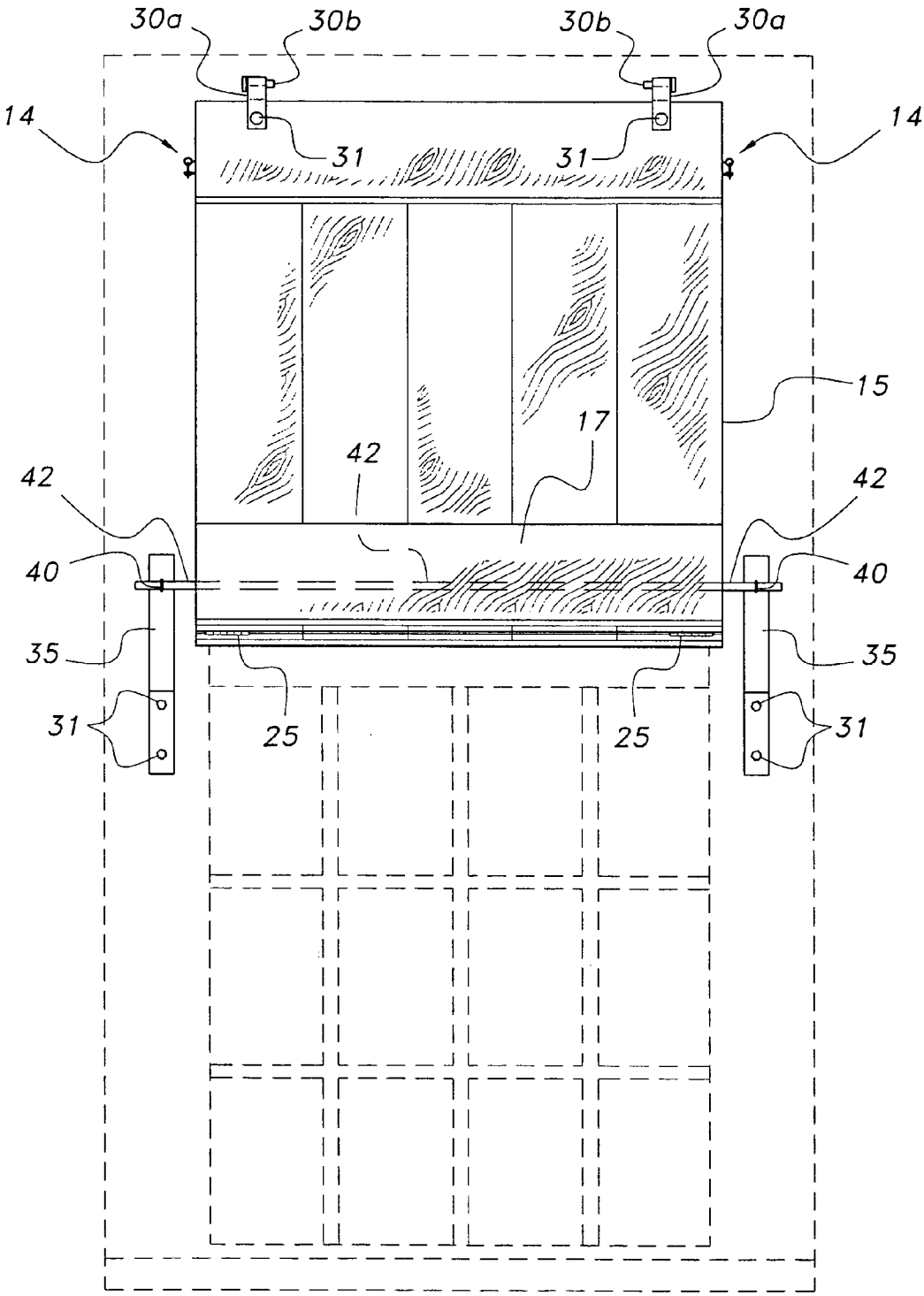
FIG. 2 is an environmental front view of the folding storm shutter according to the present invention shown in the folded configuration.
Figure 3:
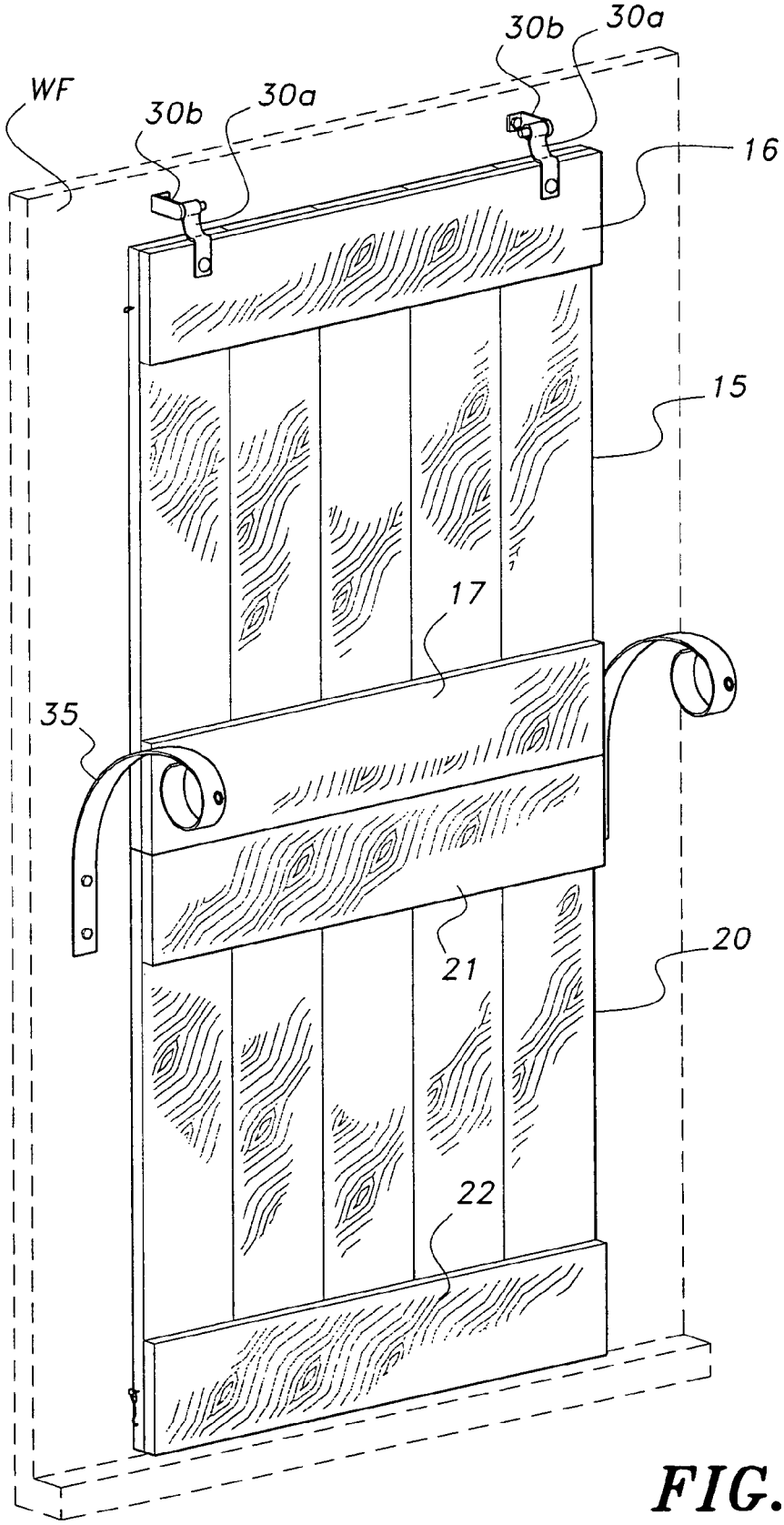
FIG. 3 is an environmental perspective view of the folding storm shutter according to the present invention in an extended shutter position to provide protection for a window.

As shown in FIGS. 1-3, the folding storm shutter 10 is provided for protecting a window W during inclement tropical weather, and can also be folded back to function as an awning when window protection is not required.

Figure 4:
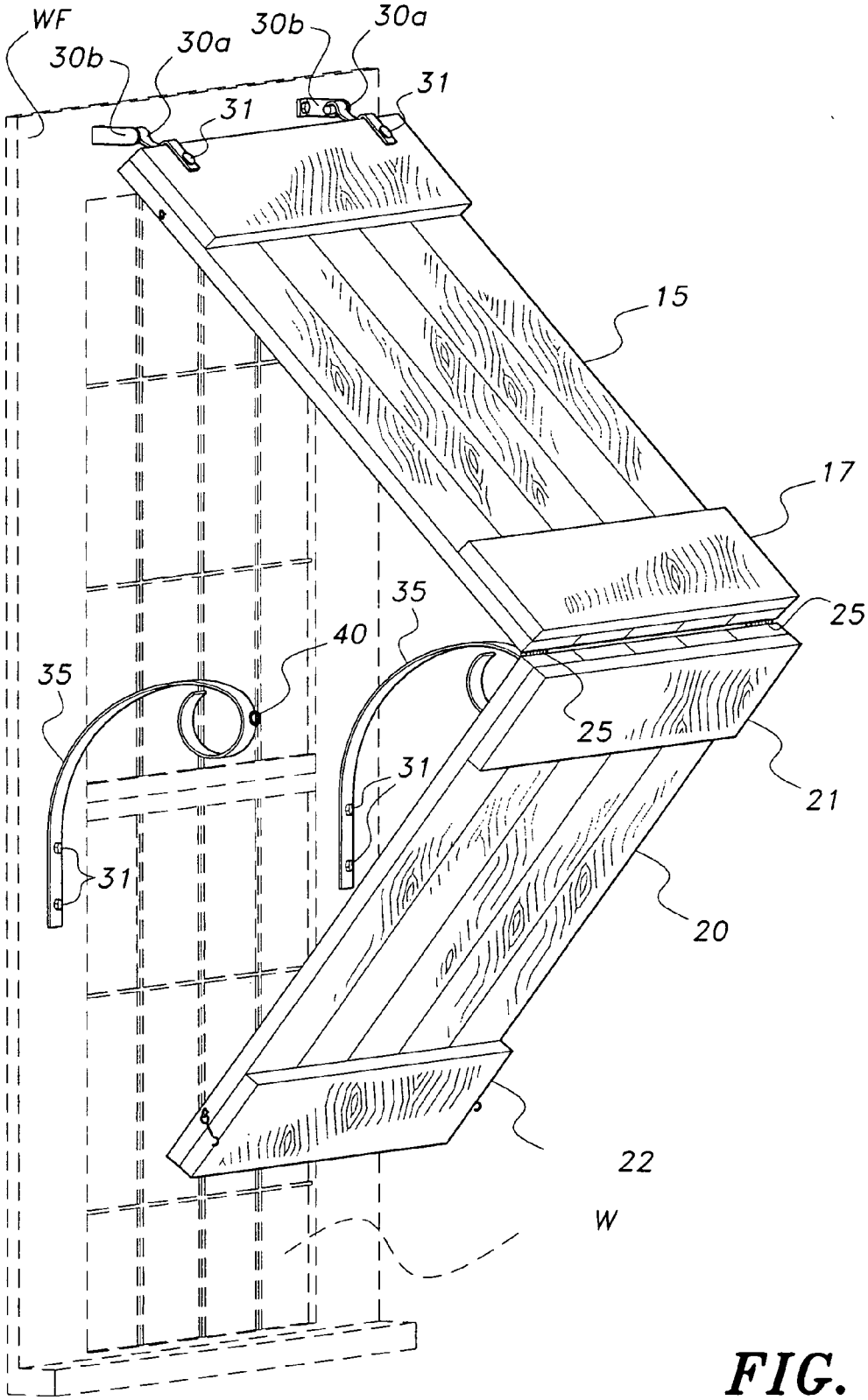
FIG. 4 is an environmental perspective view of the folding storm shutter according to the present invention in a partially folded position to show the hinges joining the upper and lower panels.

An upper shutter panel 15 is provided. As most clearly shown in FIG. 4, a lower shutter panel 20 is pivotally attached to the lower edge of the upper shutter panel 15 with hinges 25 so that the lower shutter panel 20 can extend from the upper shutter panel 15 to cover the entire window W, and, alternatively, the lower shutter panel 20 can be placed in a folded configuration under and against the upper shutter panel 15. Hinges 25 permit the lower panel 20 to rotate at least 180° so that lower panel can be extended coplanar with upper panel 15, or folded parallel underneath upper panel 15. A latching mechanism 14, such as a hook and eyelet, is provided for selectively retaining the lower shutter panel 20 in the folded configuration against upper shutter panel 15.

Hinges having an element **30*b* attached to the header of the window opening frame WF and a corresponding element 30*a* attached to an upper end of the upper shutter panel 15 pivotally attach the shutter 10 to the window frame WF. The upper and lower shutter panels 15 and 20 may have any desired structure, and any desired dimension and configuration. For temperate climates that rarely experience hurricanes, tornadoes, or other severe weather, the upper and lower shutter panels 15 and 20** may be louvered panels having a rectangular frame and relatively thin, lightweight, slanted slats providing some protection from hail and the like, as well as a decorative appearance.

In the shutter 10 shown in FIGS. 1-4, however, upper shutter panel 15 has an upper lateral crossmember 16 and a lower lateral crossmember 17. Similarly, lower shutter panel 20 has an upper lateral crossmember 21 and a lower lateral crossmember 22. The body of the panels 15 and 20 are formed from relatively robust boards, e.g., 1"×6" or 1"×8" lumber, placed side-by-side and secured at their upper and lower ends to the corresponding crossmembers 16, 17, 21 and 22, which may be the same size lumber as the body of the panels 15 and 20. This construction is suitable for severe weather regions that frequently experience hurricanes, tornadoes or the like, providing a greater degree of protection from high winds and flying debris.

The panels 15 and 20 may have a finish applied thereto, such as paint or a clear coating of wood sealant or polyurethane that leaves the natural grain and color of the lumber visible, for protecting the boards from the weather. The panels

15 and 20 are shown as being substantially equal in height, width, and thickness, although the panels 15 and 20 need not be equal in size or thickness. The description of the above panels 15 and 20 is not intended to be limiting, however, and upper and lower panels 15 and 20 may be made from any materials in any manner known for constructing shutters.

The hinge element 30*a* is securely attached to the upper shutter panel 15 using bolts 31, which preferably penetrate upper lateral cross member 16 as well as some portion of the longitudinal members of the shutter structure 15. Hinge element 30*b* is securely attached to the window frame WF.

As shown in FIGS. 1-2, a horizontal rod 42 removably supportable by two brackets 35 mounted laterally across from each other on the window frame WF with bolts 31 functions as a support for the shutter structures 15 and 20 when the shutter is in the folded back configuration. As shown in the drawings, the horizontal rod 42 is held in place by rod support rings or eyelets 40. The rod support rings 40 may be an integral part of the brackets 35 or, alternatively may be welded or otherwise affixed to the brackets 35. When a user desires to convert the system 10 from the folded shade configuration to an extended shutter configuration, the user can slip the rod 42 out of the rings 40, then unhook the latch 14 in order to permit the lower panel 20 to be extended for complete coverage of window W. Another latching mechanism may be provided to secure the lower edge or end of lower panel 20 to the window frame WF in the extended shutter configuration, if desired.

It is to be understood that the present invention is not limited to the embodiments described above, but encompasses any and all embodiments within the scope of the following claims.

I claim:

1. A folding storm shutter for covering a window, comprising:

an upper shutter panel having an upper edge adapted for pivotal attachment to a window frame above the window, and a lower edge;

a lower shutter panel pivotally attached to the lower edge of the upper shutter panel, the lower shutter panel being pivotal between an extended position co-planar with the upper shutter panel and a folded configuration parallel to the upper shutter panel for providing shade, the upper shutter panel being pivotal so that the upper and lower panels cover the window in the extended position;

a latching mechanism attached to the upper and lower shutter panels for selectively retaining the lower shutter panel in the folded configuration; and means for supporting the shutter in the folded configuration away from the window to provide shade for a portion of the window, wherein the supporting means comprises:

a pair of brackets adapted to be mounted laterally across from each other to a window frame, each of the brackets including an eyelet; and an elongate, laterally extending rod removably suspended at each end thereof within the eyelet of each of the brackets, wherein the lower shutter panel when in the folded configuration rests against the rod and when the rod is removed from the eyelet of each of the brackets, the lower shutter panel is converted to the extended position.

2. The folding storm shutter according to claim 1, further comprising a first upper crossmember and a first lower crossmember, the first upper and first lower crossmembers being disposed laterally across an upper portion of the upper shutter panel and a lower portion of the upper shutter panel, respectively.

3. The folding storm shutter according to claim 2, further comprising a second upper crossmember and a second lower crossmember, the second upper and second lower crossmembers being disposed laterally across an upper portion of the lower shutter panel an a lower portion of the lower shutter panel, respectively.

4. The folding storm shutter according to claim 3, wherein vertical members secured by the crossmembers of the shutter panels are comprised of substantially thick and substantially wide wood or composite panels placed side by side.

5. The folding storm shutter according to claim 4, wherein the substantially thick and substantially wide panels are at least one inch thick and at least six inches wide.

6. The folding storm shutter according to claim 1, wherein the latching mechanism comprises a plurality of hook members and a plurality of eye members, the hook members being attached to one of the shutter panels, the eye members being attached to the remaining shutter panel, the hook members engaging the eye members to retain the lower shutter panel in the folded configuration.

7. The folding storm shutter according to claim 1, wherein the pivotal attachment of the lower shutter panel to the lower edge of the upper shutter panel comprises at least one hinge set disposed along the coincident edges of the shutter panels.

8. The folding storm shutter according to claim 1, further comprising wood sealant disposed on the panels, the sealant leaving a natural grain and color of the panels visible while protecting the panels from the weather.

* * * * *